United States Patent [19]

Mascotte et al.

[11] 3,994,491

[45] Nov. 30, 1976

[54] STARTER GATE

[75] Inventors: Lawrence LaVerne Mascotte, Portland; Preston Lynn Petty, Newberg, both of Oreg.

[73] Assignee: Lawrence L. Mascotte, Portland, Oreg.

[22] Filed: June 2, 1975

[21] Appl. No.: 582,916

Related U.S. Application Data

[63] Continuation of Ser. No. 439,133, March 19, 1974, abandoned.

[52] U.S. Cl. ..... 272/4; 49/34; 49/131; 119/15.5

[51] Int. Cl.[2] ..... A63K 3/02

[58] Field of Search ..... 119/15.5; 272/4, 5; 49/34, 131; 104/60

[56] References Cited

UNITED STATES PATENTS

| | | | |
|---|---|---|---|
| 601,014 | 3/1898 | Finigan | 119/15.5 |
| 717,249 | 12/1902 | McGinnis | 119/15.5 |
| 1,723,779 | 8/1929 | Hamilton | 119/15.5 |
| 3,303,613 | 2/1967 | Seuntjens | 49/131 |

*Primary Examiner*—J.N. Eskovitz
*Attorney, Agent, or Firm*—Adrian J. LaRue

[57] ABSTRACT

A starter gate comprises a plurality of cable-holding members pivotally mounted on base members. A latching mechanism latches the cable-holding members in a vertical position thereby maintaining cables in a suspended condition behind which vehicles, animals or the like are positioned preparatory to starting a race. A latch-releasing mechanism is actuated by a starter so that the cable-holding members and cables carried thereby move to a horizontal position adjacent the raceway thereby enabling the vehicles or animals to start the race without hindrance from the cables.

9 Claims, 3 Drawing Figures

STARTER GATE

This is a continuation of application Ser. No. 439,133 filed Mar. 19, 1974 now abandoned.

BACKGROUND OF THE INVENTION

Starter gates are known which include metal pipers having a diameter of three or more inches mounted on pipe-mounting members. These pipe-mounting members are positioned across a raceway at spaced intervals. The number of pipes that are normally used constitute at least three in order to provide a suitable starting barrier which prevents false starts. A mechanical tripping mechanism is connected to the pipe-mounting members to trip or release the pipe-mounting members to enable them to move from a vertical to a horizontal position so that the race can be commenced.

This type of starter gate has not proved satisfactory. One reason is that the mechanical tripping mechanism is difficult to operate and does not positively trip all of the tripping mechanisms simultaneously thereby allowing the pipe-mounting members that have been tripped to open the starter gate along this area but not allowing the pipe-mounting members that have not been tripped to open the gate along this area thereby creating a false start.

Another reason that this starter gate is not satisfactory is that the large size of the pipe is difficult to move over, especially by motorcycles, when the pipes are in a down position adjacent the raceway. In the event it is raining or wet or muddy conditions are prevalent, this makes the pipe starter gate more hazardous and dangerous, because the pipes are now slippery and the instant acceleration of the wheels of the vehicles when the starter gate is actuated will cause the wheels to slip and slide on the pipes and this can result in loss of control of the vehicles, damage to the vehicles and injury to the operators.

SUMMARY OF THE INVENTION

The present invention relates to starter gates and more particularly to starter gates that are operated positively and with no hazardous or dangerous restraining members.

An object of the present invention is to provide a starter gate that operates positively to preclude false starts.

Another object of the present invention is the provision of a starter gate that does not have restraining members which can be hazardous or dangerous.

A further object of the present invention is to provide a starter gate having means onto which restraining members are mounted for disposition across a raceway, means to maintain the mounting means in an up position, and means to permit the mounting means and the restraining members thereon to move to a down position.

An additional object of the present invention is the provision of a latch means and latch-operating means to latch cable-mounting means in an up position and to unlatch the latch means via operation of the latch-operating means so that the cable-mounting means is moved to a down position.

These and other objects of the invention will appear more fully from the following description and the accompanying drawings illustrating a preferred embodiment of the invention. It is to be understood that changes may be made from the exact details shown and described without departing from the principles of the invention.

DETAILED DESCRIPTION OF THE INVENTION

The present invention is a starter gate for starting a race with vehicles, animals or the like, but the present invention will be described in conjunction with starting a motorcycle race.

Figure 1:
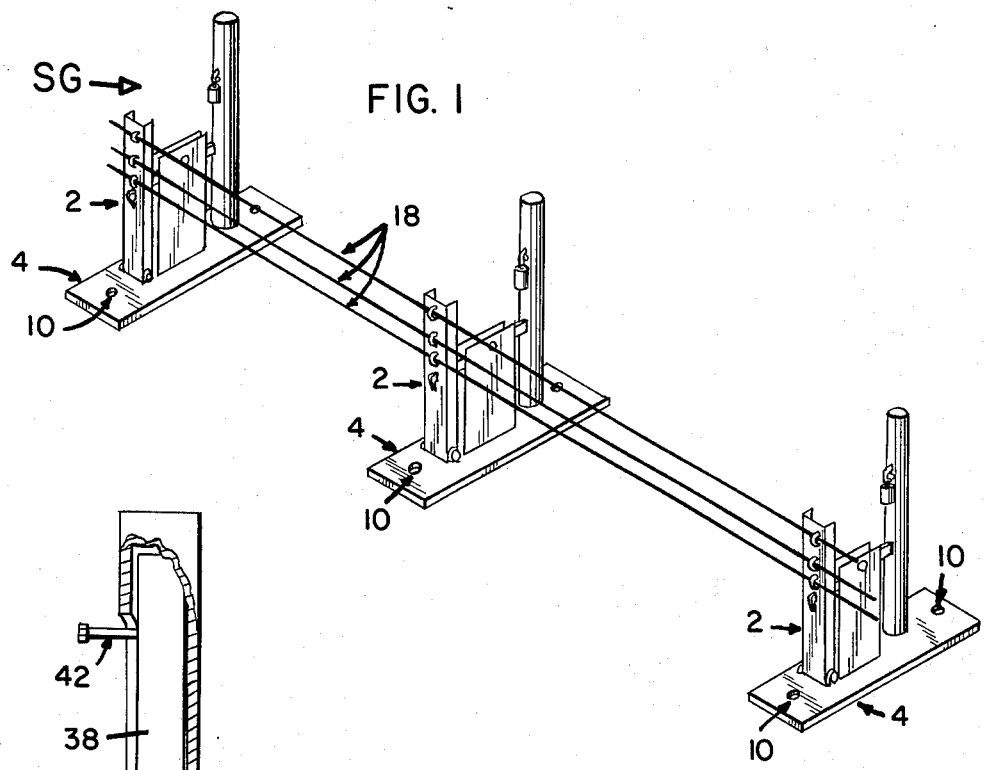
FIG. 1 is a perspective view illustrating a starter gate.

Turning now to the drawings, FIG. 1 shows a starter gate SG which comprises three cable-holding members 2 disposed across a raceway which can be a dirt or cinder track as the case may be. Cable-holding members 2 are pivotally mounted on a base plate 4 via projections 6 on plate 4 and pivot pin 8. Plate 4 is secured onto the raceway via pegs or bolts 10 that extend through holes 12 in plate 4.

Cable-mounting member 2 is a U-shaped or channel-shaped member having a slot 14 in its bight or bottom section. U-shaped bolts 16 are secured in the bight section of cable-mounting member 2 at spaced locations therealong above slot 14 to secure cables 18 therein and onto cable-mounting member 2. Bolts 16 do not clamp cables 18 tightly against member 2 but permit the cables to slide therein and therefore relative to its respective cable-mounting member. An anchor or enlarged member (not shown) is secured to the ends of cables 18 so that these ends do not pass through bolts 16 located on the outermost cable-mounting members 2 if more than two cable-mounting members are used in the starter gate and also so long as the cables are taut. Alternatively, the ends of cables 18 can be anchored in the area or ground adjacent the raceway, or as desired so long as cables 18 are in a sufficiently taut condition.

A latching member 20 is pivotally mounted between plates 22 secured onto plate 4 and it includes a latching head 24 which extends through slot 14 and engages the bight section of cable-mounting member 2 to latch member 2 in an up position which suspends cables 18 across the raceway so that motorcycles are restrained from starting a race. As can be discerned, latching head 24 has a cam surface **24*a* to pass through slot 14 via the camming action between cam surface 24*a* and the area of the bight section adjacent slot 14 when cable-holding member 2 is moved from an open to a closed position and then latch head 24 latches cable-holding member in an up position. A spring 24*b* extends between latch member 20 and one of plates 22 to maintain latch member 20** in a latching position.

The free end of latching member 20 extends through slot 26 and within tubular member 28 secured on plate 4. A solenoid 30 is mounted on member 28 and its armature 32 is pivotally connected to weight latch 34 which is pivotally mounted on tubular member 28.

A leg of latch 34 extends through a slot 36 in member 28 and maintains a weight 38 in a latch-tripping position in tubular member 28. Spring 40 mounted between member 28 and latch 34 maintains latch 34 in position and moves it to a latching position when weight 38 is moved above latch 34. Tubular member 28 defines a guide means for guiding movement of weight 38 therein.

Figure 2:
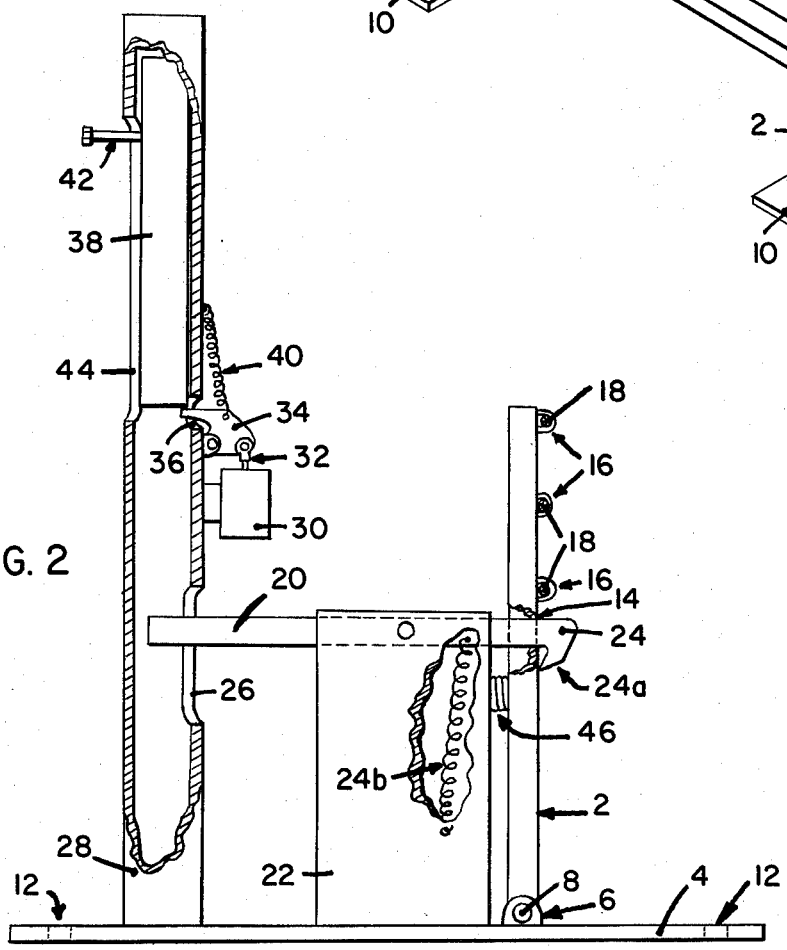
FIG. 2 is a side elevational view with parts in broken cross section of a movable cable-holding member in a normally latched position thereby maintaining the cables up so that the starter gate is in a closed position.
Figure 3:
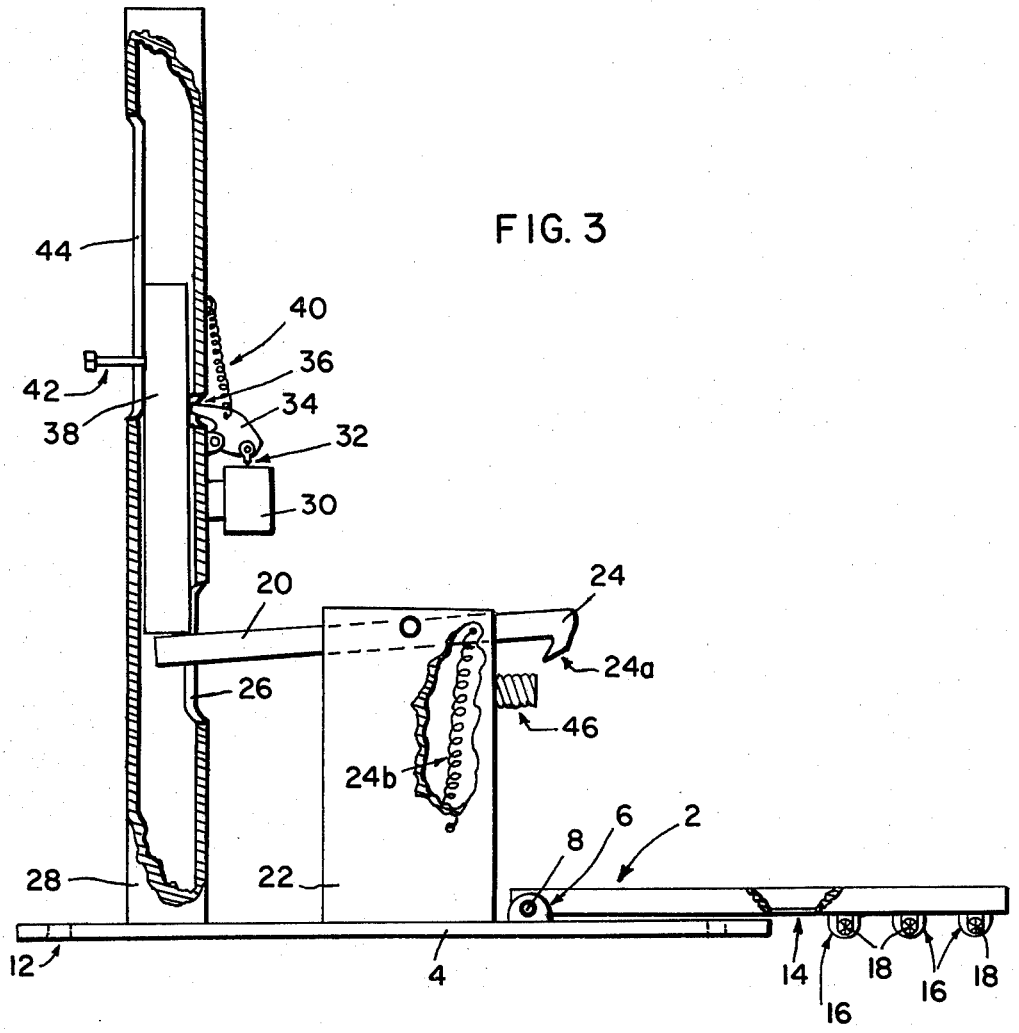
FIG. 3 is similar to FIG. 2 with the movable cable-holding member in an unlatched and therefore down position which renders the starter gate open.

A pin 42 extends through a slot 44 in tubular member 28 to move weight 38 to a latch-tripping position as shown in FIG. 2. When weight 38 is moved from a position in engagement with latch member 20 via pin 42, it engages latch 34 and moves it outwardly and biases spring 40. Once weight 38 has cleared latch 34, spring 40 moves latch 34 into position thereby retaining weight 38 in its latch-tripping position. Armature 32 limits the movement of latch 34 within tubular member 28 through slot 36.

With cable-mounting members 2 in their upper latched position, weights 38 in their latch-tripping positions and solenoids 30 electrically connected together in parallel with a power source and starter switch (not shown), the starting gate is now in a closed position so that motorcycles with their riders thereon can be lined up therebehind. The starter actuates the starter switch and this energizes the solenoids 30 which moves latches 34 outwardly thereby freeing weights 38. Weights 38 move into engagement with latch members 20 causing latching heads 24 to move upwardly thereby freeing cable-holding members 2. Thrust springs 46 move cable-mounting members 2 and the cables 18 thereon to a down position so that the motorcycles can proceed thereacross thereby starting the race.

After the motorcycles have passed through the starting gate, cable-mounting members 2 are moved to the up positions and latched thereat via latching heads 24 of latch members 20 and weights 38 are moved via pins 42 to their up positions and held thereat by latches 34. Weights 38 in being moved to their up positions, cam latches 34 out of their paths and latches 34 are moved to their latching positions via springs 40.

It can readily be discerned that there has been illustrated and described a starter gate that is readily mounted in position across a raceway in order to properly start a race by actuation of latch-actuating means. Although the invention has been explained with reference to a particular embodiment, it is to be appreciated that various adaptations and modifications may be made without departing from the appended claims.

The invention is claimed in accordance with the following:

1. A starter gate for starting a race of motorcycle racers comprising:

base means for engagement with a raceway and for disposition across the raceway at spaced intervals thereacross;

securing means for securing said base means in position at the spaced intervals;

cable-holding means having cable means secured thereon;

means positioned on said base means and pivotally mounting said cable-holding means above said base means so that said cable-holding means can be positioned in an up position with said cable means providing a barrier behind which the motorcycle racers are positioned prior to starting a race and a down position to enable the motorcycle racers to start the race by passing over the cable means;

latch-mounting means provided on said base means adjacent said cable-holding means;

latch means pivotally mounted on said latch-mounting means, said latch means including a latch section and an operating section, said latch section adapted for latchably engaging said cable-holding means to hold said cable-holding means in said up position; and latch-operating means provided on said base means adjacent said latch-mounting means for operating said latch section thereby causing said latch section to unlatch said cable-holding means so that said cable-holding means and said cable means thereon are moved to said down position under at least the partial effect of gravity whereby the motorcycle racers can pass over said cable means in engagement with the raceway.

2. A starter gate according to claim 1 wherein spring means are provided on said base means to move said cable-holding means toward said down position when said latch means unlatches said cable-holding means.

3. A starter gate according to claim 1 wherein said latch-operating means comprises guide means, weight means for movement along said guide means, latching means mounted on said guide means for latching said weight means in a latch-actuating position, and means for operating said latching means so that said latching means frees said weight means enabling said weight means to engage said operating section and actuate same to unlatch said cable-holding means.

4. A starter gate according to claim 3 wherein said operating means comprises solenoid means having armature means connected to said latching means.

5. A starter gate according to claim 3 wherein said guide means comprises tubular means in which said weight means moves.

6. A starter gate member for a starter gate for starting a race of motorcycle racers comprising:

a base plate for disposition onto a raceway;

cable-mounting means adapted to have cable means mounted thereto;

pivot means provided on said base plate and connected to one end of said cable-mounting means so that said cable-mounting means can be positioned in an up position with the cable means adapted to provide a barrier behind which the motorcycle racers are positioned and a down position to enable the motorcycle racers to start the race by passing over the cable means;

latch-mounting means mounted on said base plate adjacent said cable-holding means;

latch means pivotally mounted on said latch-mounting means, said latch means including a latching member and an operating member, said latching member adapted to latchable engage said cable-holding means to hold said cable-holding means in said up position; and latch-operating means mounted on said base plate adjacent said latch-mounting means for operating said operating member thereby causing said latching member to unlatch said cable-holding means so that said cable-holding means and the cable means thereon are moved to said down position under at least the partial effect of gravity whereby the motorcycle racers can pass over the cable means in engagement with the raceway.

7. A starter gate member according to claim 6 wherein thrust spring means is mounted between said latch-mounting means and said cable-mounting means for springably moving said cable-mounting means to said down position when unlatched.

8. A starter gate member according to claim 6 wherein said latch-operating means comprises guide means, weight means movably mounted thereon, weight-latching means mounted on said guide means to latch said weight means in a latch-operating position, and weight-latch operating means connected to said weight-latching means to operate same.

9. A starter gate member according to claim 8 wherein said weight-latch operating means comprises solenoid means having armature means connected to said weight-latching means.

* * * * *